US006947680B2

(12) United States Patent
Oka et al.

(10) Patent No.: US 6,947,680 B2
(45) Date of Patent: Sep. 20, 2005

(54) IMAGE FORMING APPARATUS

(75) Inventors: Yushi Oka, Chiba (JP); Akihiko Sato, Chiba (JP); Shinichi Takata, Chiba (JP); Shigemichi Hamano, Chiba (JP); Toru Ono, Ibaraki (JP); Kenji Morita, Ibaraki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/793,772

(22) Filed: Mar. 8, 2004

(65) Prior Publication Data

US 2004/0179857 A1 Sep. 16, 2004

(30) Foreign Application Priority Data

Mar. 10, 2003 (JP) ..... 2003-063267

(51) Int. Cl.[7] ..... G03G 15/00

(52) U.S. Cl. ..... 399/45; 399/50; 399/115; 399/168

(58) Field of Search ..... 399/227, 45, 50, 399/115, 168–176

(56) References Cited

U.S. PATENT DOCUMENTS 5,835,821 A * 11/1998 Suzuki et al. ..... 399/100
6,064,837 A * 5/2000 Hashimoto et al. ..... 399/50
6,160,569 A * 12/2000 Fujimori et al. ..... 347/262

FOREIGN PATENT DOCUMENTS

EP 0766146 A2 * 2/1997 ..... G03G/15/02
JP 60078465 A * 5/1985 ..... G03G/15/04

* cited by examiner

*Primary Examiner*—Arthur T. Grimley
*Assistant Examiner*—Peter Lee
(74) *Attorney, Agent, or Firm*—Fitzpatrick, Cella, Harper & Scinto

(57) ABSTRACT

In a case where a rotating speed of an intermediate transfer member is reduced during the process of image formation, carriers may adhere to a photosensitive member before the rotating speed of the intermediate transfer member stabilizes. To cope therewith, in changing an image formation speed in accordance with a conveying speed of a recording material on completion of primary transfer, a developing rotary is rotated so as to keep any developing device off a developing position. Consequently, a situation in which the carriers adhere to an image bearing member can be avoided. At the same time, stopping a charging operation of a charger enables a longer service life of the image bearing member.

4 Claims, 6 Drawing Sheets

IMAGE FORMING APPARATUS

BACKGROUND OF THE INVENTION

1. Field of the Invention

The present invention relates to an image forming apparatus employing an electrophotographic process or an electrostatic recording process. In particular, the present invention relates to an image forming apparatus such as a copying machine, a printer, or a facsimile machine.

2. Related Background Art

Up to now, an image forming apparatus employing an electrophotographic process as described below has been proposed.

To be specific, a developing rotary is arranged so as to oppose a photosensitive member, the developing rotary including plural two-component developing devices containing toner and carriers. The developing devices of the developing rotary are disposed one by one at a developing portion with the photosensitive member to form a toner image. The toner images formed on the photosensitive member are successively primarily transferred onto an intermediate transfer member. Thereafter, the toner image formed on the intermediate transfer member is secondarily transferred onto a recording material and then heat-melted by a fixing device to be fixed thereonto. The recording material with the fixed image is discharged to the outside of the apparatus.

In such an image forming apparatus, there is a case where a toner image transferred onto a special recording material such as thick sheet or an OHP sheet (light-transmissive resin for an overhead projector) is fixed thereonto. Such a special sheet (recording material) involves a requisite heat quantity per unit area, which is larger than that of plain paper. As a result, the apparatus is structured such that the sheet is applied with a larger quantity of heat than that of the plain paper by reducing a conveying speed (fixing rate) upon passing the sheet through the fixing device.

In this case, regarding an image forming apparatus where a distance between a fixing device and a secondary transfer device is short, when the toner image primarily transferred from the photosensitive member onto the intermediate transfer member is secondarily transferred onto the sheet, a rotating speed of the intermediate transfer member is reduced under control according to a type of recording material, i.e., a speed (fixing rate) at which the recording material passes through the fixing device.

Note that, the rotating speed of the intermediate transfer member is set uniform until the toner image formed on the photosensitive member has been primarily transferred to the intermediate transfer member irrespective of whether the recording material is plain paper or special sheet (e.g., the thick sheet or the OHP sheet).

Note that, as mentioned above, in the case of using the thick sheet or the OHP sheet, the following control is performed on account of the short distance between the fixing device and the secondary transfer device. That is, the rotating speed of the intermediate transfer member is reduced in correspondence with the fixing rate as compared with the plain paper, from the completion of the primary transfer until secondary transfer starts.

After that, the rotating speed of the intermediate transfer member is increased to a normal speed under control for the next image formation.

In the case of changing the rotating speed of the intermediate transfer member as described above, it takes some time for the rotating speed of the intermediate transfer member to stabilize at the changed speed.

Accordingly, before the rotating speed of the intermediate transfer member stabilizes, if the developing device is at a developing position opposite to the photosensitive member, a problem arises in that carriers adhere to the photosensitive member from the developing device.

SUMMARY OF THE INVENTION

The present invention has been made in view of the above-mentioned problems and accordingly has an object to provide an image forming apparatus capable of preventing undesirable adhesion of a developer from a developing device to an image bearing member.

Another object of the present invention is to provide an image forming apparatus capable of prolonging a service life of an image bearing member as well as preventing undesirable adhesion of a developer from a developing device to the image bearing member.

Another object of the present invention is to provide an image forming apparatus including: an image bearing member; electrostatic image forming means for forming an electrostatic image on the image bearing member; a plurality of developing devices for developing the electrostatic image on the image bearing member with a developer; a moving member holding the plurality of developing devices and selectively moving a predetermined developing device to a developing position; an intermediate transfer member onto which a developer image is primarily transferred from the image bearing member, the developer image on the intermediate transfer member being secondarily transferred onto a recording material; and speed reducing means for reducing a speed of the intermediate transfer member according to a type of the recording material on completion of the primary transfer, in which when the speed of the intermediate transfer member is reduced, the moving member is actuated to retreat any of the developing devices from the developing position.

Other objects of the present invention will be apparent upon reading the following detailed description with reference to the accompanying drawings.

DESCRIPTION OF THE PREFERRED EMBODIMENTS

Embodiment

Figure 1:
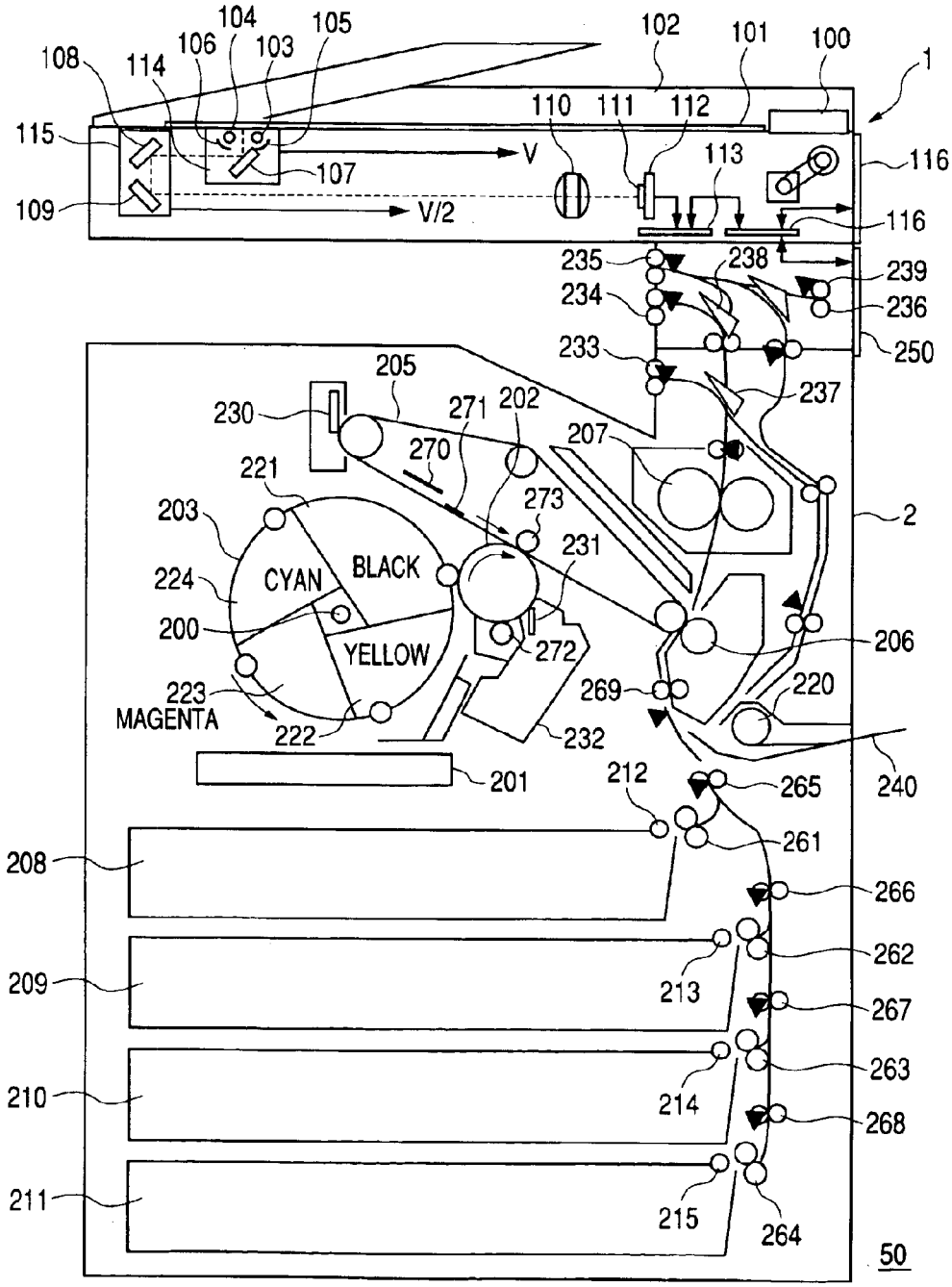
FIG. 1 shows a schematic structure of an image forming apparatus according to an embodiment of the present invention.

FIG. 1 shows a schematic structure of a full-color image forming apparatus according to an embodiment of the present invention. Referring to FIG. 1, a basic structure thereof is described.

(Image Formation Sequence)

First, a structure of a color reader portion 1 is described. Reference numeral 101 denotes a document glass stand (platen); and 102, an automatic document feeder (ADF). Note that, a specular or white pressure plate may be mounted thereto instead of using the automatic document feeder 102. Reference numerals 103 and 104 each denote a light source for illuminating a document, such as a halogen lamp, a fluorescent lamp, or a xenon tube (lamp); 105 and 106, reflectors for condensing light from the light sources 103 and 104 onto a document; 107 to 109, mirrors; 110, a condenser lens for condensing reflected light or projected light from the document onto a charge coupled device (CCD) image sensor (hereinafter, referred to as a CCD) 111; 112, a substrate having the CCD 111 mounted thereon; 100, a control portion for controlling the whole image forming apparatus; 113, a digital image processing portion; 114, a carriage for accommodating the light sources 103 and 104, the reflectors 105 and 106, and the mirror 107; and 115, a carriage for accommodating the mirrors 108 and 109. The carriage 114 and the carriage 115 are mechanically moved in a sub-scanning direction Y orthogonal to an electrically scanning direction (main-scanning direction X) of the CCD 111 at a speed V and a speed V/2, respectively to thus scan the entire surface of the document. Denoted by 116 is an external interface (I/F) with other devices.

Figure 2:
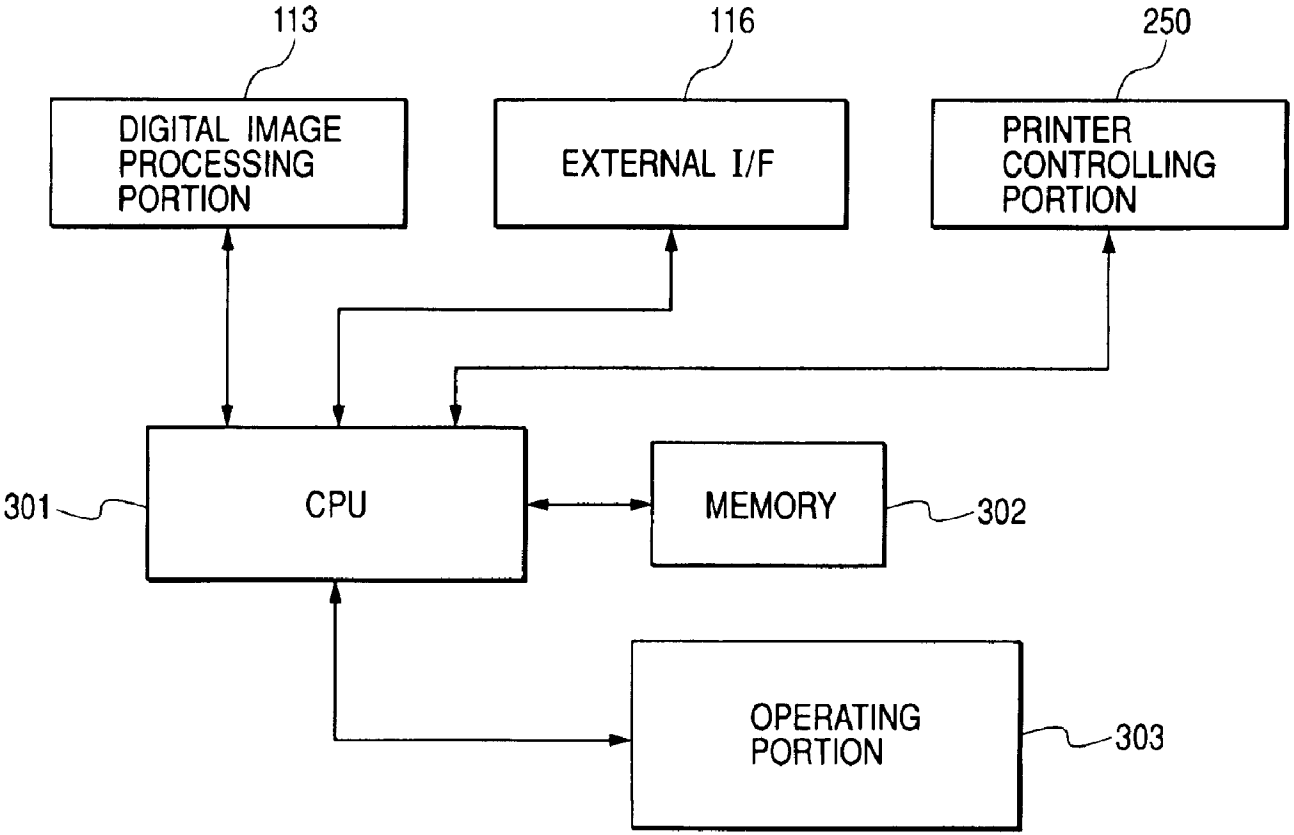
FIG. 2 is a block diagram of a control processing portion of the image forming apparatus.

As shown in FIG. 2, the control portion 100 is composed of a CPU 301 with an I/F for exchanging information with the digital image processing portion 113 and a printer controlling portion 250 used for the control, an operating portion 303, and a memory 302. The operating portion 303 is constituted of a liquid crystal display with a touch panel for inputting information on processing in execution by an operator, notifying the operator of the information on the processing, or giving a warning against the processing concerned.

Figure 3:
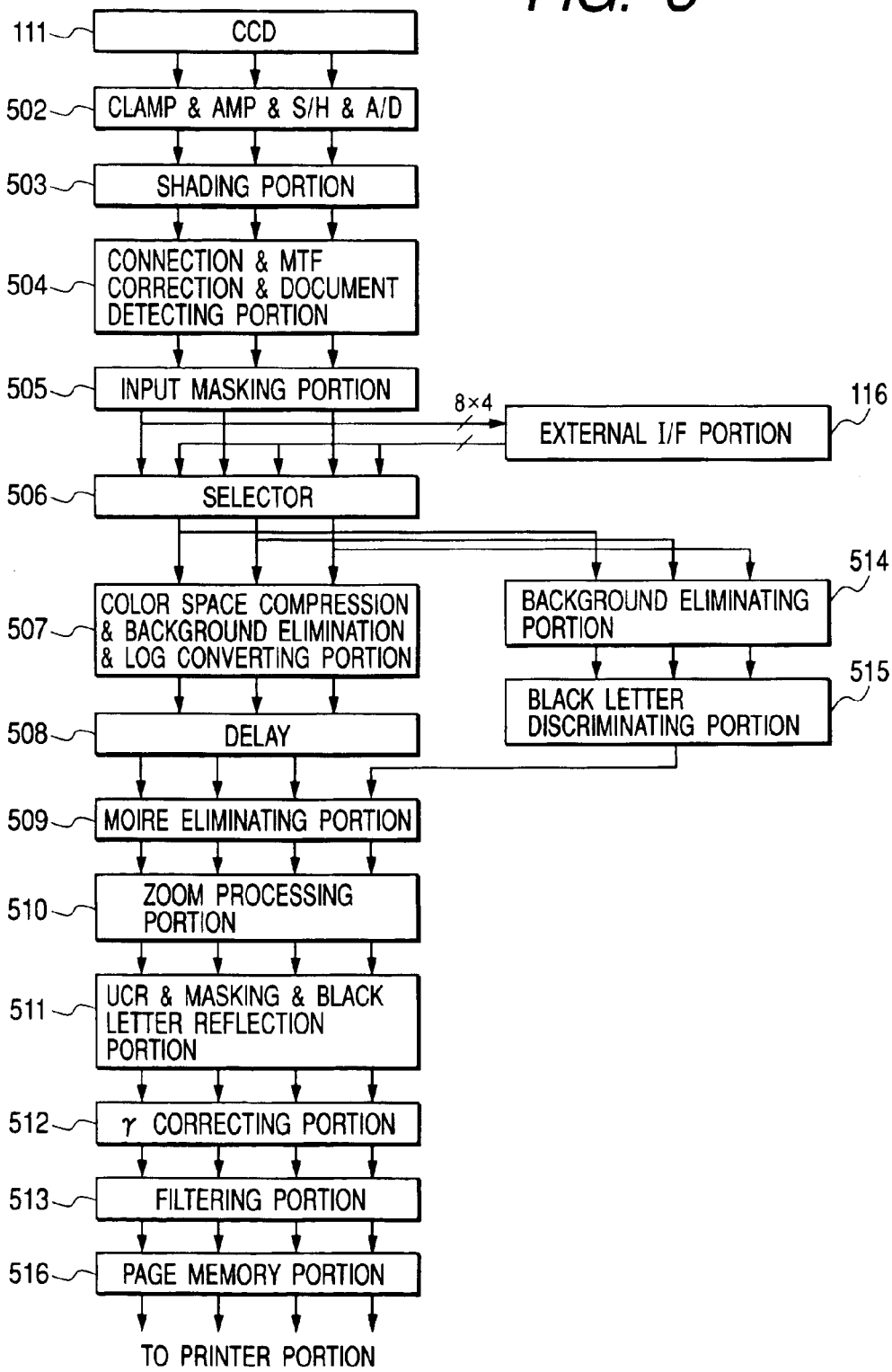
FIG. 3 shows a main part of a digital image processing portion in conjunction with its operational flow up to a printer portion from an input with a CCD upon image reading.

Next, the digital image processing portion 113 is detailed. FIG. 3 is a block diagram showing a detailed structure in conjunction of its operational flow of the digital image processing portion 113.

A document set on the document glass stand reflects the light from the light sources 103 and 104. The reflected light is guided to the CCD 111 and converted into an electrical signal. (In the case where the CCD 111 is a color sensor, R, G, and B color filters may be arranged on a 1-line CCD in the order of R, G, and B in line. Alternatively, a 3-line CCD may be used such that R color filters, G color filters, and B color filters are respectively arranged on the corresponding line. Further, an on-chip filter or a filter separate from the CCD may be used.) The electrical signal (analog image signal) is input to the digital image processing portion 113 and subjected to sampling and holding (S/H) at a clamp & Amp & S/H & A/D portion 502. The portion clamps a dark level of the analog image signal to a reference potential; amplifies the signal to a predetermined level (the processing is not limited to the order of the clamp, the amplification, the S/H, and A/D); and A/D-converts the signal, for example, into R, G, and B digital signals of 8-bit each. The R, G, and B signals undergo shading correction and black correction in a shading portion 503. After that, in the case of using the 3-line CCD as the CCD 111, connection processing is performed at a connection & MTF correction & document detecting portion 504 while adjusting a delay amount for each line according to a readout speed because the readout position differs between the lines to correct the signal timing in such a way that readout positions of the three lines coincide with one another. Regarding the MTF correction, since MTF in the readout operation changes depending on the readout speed or zoom, the change is corrected. The document detection is performed as follows: the document size is recognized by scanning the document on the document glass stand. An input masking portion 505 corrects a spectral characteristic of the CCD 111 and spectral characteristics of the light sources 103 and 104 and the reflectors 105 and 106 by using the digital signal after the readout position timing correction. Outputs of the input masking portion 505 are input to a selector 506 that can receive either the signals from an external I/F portion 116 or the signals from the input masking unit 505. Signals output from the selector 506 are input to a color space compression & background elimination & LOG converting portion 507 and a background eliminating portion 514. The signal input to the background eliminating portion 514 undergoes the background elimination and then is input to a black letter discriminating portion 515 for discriminating whether or not the input signal represents a black letter on the document to thus generate a black letter signal representing the black letter on the document. Also, at the color space compression & background elimination & LOG converting portion 507 having the other output from the selector 506 input thereto, it is judged whether or not the readout image signal falls within a reproducible range of a printer upon the color space compression. If the signal falls within such a range, no correction is conducted. Otherwise, the image signal is corrected to fall within the reproducible range of a printer. Then, the background eliminating processing is conducted to convert the R, G, and B signals into Y, M, and C signals at the LOG converging portion. A delay portion 508 adjusts the timings of the output signals from of the color space compression & background elimination & LOG converting portion 507 with respect to the signals generated by black letter discriminating portion 515 for timing correction. The two signals undergo moire component elimination at a moire eliminating portion 509 and zoom processing in a main-scanning direction at a zoom processing portion 510. Denoted by 511 is a UCR & masking & black letter reflection portion where the signals or Y, M, and C signals processed at the zoom processing portion 510 undergo UCR processing to thereby generate Y, M, C, and K signals. Then, a masking processing portion corrects the signals into signals suited to an output operation of a printer. At the same time, a discrimination signal generated at the black letter discriminating portion 515 is fed back to the Y, M, C, and K signals. The signal processed at the UCR & masking & black letter reflection portion 511 is subjected to density adjustment at a γ correcting portion 512 and then subjected to smoothing and edge processing at a filtering portion 513. The thus processed image data is stored in a page memory portion 516 and output to a printer portion in accordance with an image formation timing of the printer portion.

Next, a structure of a color printer portion 2 is described. In FIG. 1, denoted by 250 is the printer controlling portion where a control signal from the CPU 301 in the control portion 100 for controlling the whole image forming apparatus is received. The control portion 100 effects the foregoing image readout control on the color reader portion 1 to temporarily store readout image data in the memory 302 in the control portion. Then, in accordance with a reference timing from the printer controlling portion 250, the image data in the memory is converted into an image data signal in synchronization with a video clock, followed by sending the signal to the printer controlling portion 250.

The printer portion performs an operation as described later based on the control signal from the printer controlling portion 250. Denoted by 201 is a laser scanner for scanning and irradiating, by using a polygon mirror, a photosensitive drum 202 in a main-scanning direction with laser light in correspondence with the image data signal.

The photosensitive drum 202 rotates counterclockwise and an electrostatic latent image is formed thereon with the laser scanner 201. A rotary color developing device 203 is composed of developing devices 221, 222, 223, and 224 corresponding to black, yellow, magenta, and cyan, respectively, which are arranged about a rotation axis 200 clockwise. The developing devices 221 to 224 contain two-component developers in multiple colors including toner and carriers. Note that in this embodiment, the developing devices 221 to 224 corresponding to black, yellow, magenta, and cyan, respectively are easily detachably attachable to the rotary color developing device 203 and are each attached at a position of corresponding color.

When the toner image is formed on the photosensitive drum 202, the black developing device 221 is solely used in the case of developing a black solid image. The rotary color developing device 203 is rotated until a developing sleeve of the black developing device 221 comes to a position opposite to the photosensitive drum 202. Toner particles are attracted in the air from the developing device 221 to the photosensitive drum 202 surface in an amount corresponding to a potential difference between the photosensitive drum 202 surface and the developing sleeve surface. In this case, the electrostatic latent image is formed on the photosensitive drum 202 surface and a developing bias is applied to the developing sleeve surface. Thus, the electrostatic latent image formed on the photosensitive drum 202 surface is developed. In contrast, in the case of forming a color image, the rotary color developing device 203 is rotated about the rotation axis 200 through the rotation of a stepping motor (not shown) such that predetermined one of the developing devices 221 to 224 selectively comes to the developing position closer to (or in contact with) the photosensitive drum 202 in correspondence with development target color. At such a position, the development is conducted. The toner is supplied from the developing devices 221 to 224 in an amount corresponding to the charge amount on the photosensitive drum 202 to develop the electrostatic latent image on the photosensitive drum 202.

The toner image formed on the photosensitive drum 202 is transferred onto an intermediate transfer member 205 rotating counterclockwise through the clockwise rotation of the photosensitive drum 202. The primary transfer to the intermediate transfer member 205 is completed by rotating the intermediate transfer member 205 once in the case of the black solid image and four times in the case of the full-color image. The intermediate transfer member 205 allows duplex image formation when forming an image of a specific recording paper size, e.g., A4 size or smaller.

Meanwhile, the recording sheets are picked up by pick-up rollers 212/213/234/215 in each cassette stage from cassettes (first stage cassette 208/second stage cassette 209/third stage cassette 210/fourth stage cassette 211) and conveyed by sheet feeding rollers 261/262/263/264 of each cassette stage. The sheets are conveyed up to a registration roller 269 by longitudinal path conveying rollers 265/266/267/268. In the case of manually feeding the sheets, the recording sheets stacked on a manual feed tray 240 are conveyed up to the registration roller 269 by a manual feed roller 220. Then, at a timing of completing the transfer to the intermediate transfer member 205, the recording sheet is conveyed between the intermediate transfer member 205 and a secondary transfer roller 206. After that, the recording sheet is nipped and conveyed between the secondary transfer roller 206 and the intermediate transfer member 205 toward a fixing device while being in press contact with the intermediate transfer member 205. Thus, the toner image on the intermediate transfer member 205 is secondarily transferred onto the recording sheet. The toner image transferred onto the recording sheet is applied with heat and pressure by means of a fixing roller and a pressure roller 207 and fixed onto the recording sheet. A transfer residual toner not transferred to the recording sheet but remaining on the intermediate transfer member 205 is scraped off from the intermediate transfer member 205 surface by an intermediate transfer cleaning blade 230 capable of abutting against/separating from the surface of the intermediate transfer member 205. In this way, the surface is cleaned upon post-processing control in the later part of image formation sequence. In a photosensitive drum unit, the residual toner is scraped off from the drum surface with a blade 231 and carried to a waste toner box 232 integrated into the photosensitive drum unit. Either negative- or positive-polarity residual toner that may unexpectedly adhere to the secondary transfer roller surface is attracted to adhere on the intermediate transfer member 205 by alternately applying a secondary transfer positive bias and a secondary transfer reverse bias. The residual toner is scraped off with the intermediate transfer cleaning blade 230 to thus completely clean the residual toner off the member or roller. The post-processing is thus completed.

The recording sheet to which the toner image is fixed is discharged toward a delivery roller 233 while switching a direction of a first sheet delivery flapper 237 to a first delivery roller direction for first sheet delivery. The recording sheet is discharged toward a delivery roller 234 while switching the directions of the first sheet delivery flapper 237 and a second sheet delivery flapper 238 to a second delivery roller direction for second sheet delivery. For the third sheet delivery, a surface reverse operation is performed with a reverse roller 235. For this operation, while switching the directions of the first sheet delivery flapper and the second sheet delivery flapper to the reverse roller 235 direction once, the sheet is reversed with the reverse roller 235. After being reversed at the reverse roller 235, the sheet is discharged toward a third delivery roller 236 while switching a direction of a third sheet delivery flapper to a third sheet delivery roller direction. In the case of duplex sheet delivery, the sheet is reversed once with the reverse roller 235 as in the third sheet delivery. The direction of the third sheet delivery flapper is switched to a duplexer direction and the sheet is conveyed to the duplexer. The image formation is suspended a given period after the recording sheet is detected by a duplex sensor. As soon as the apparatus is ready to form an image again, the sheet is refed for image formation on the other side.

Hereinafter, a detailed description is given of an operation upon the image formation by type of sheet.

[Plain Paper]

Figure 4:
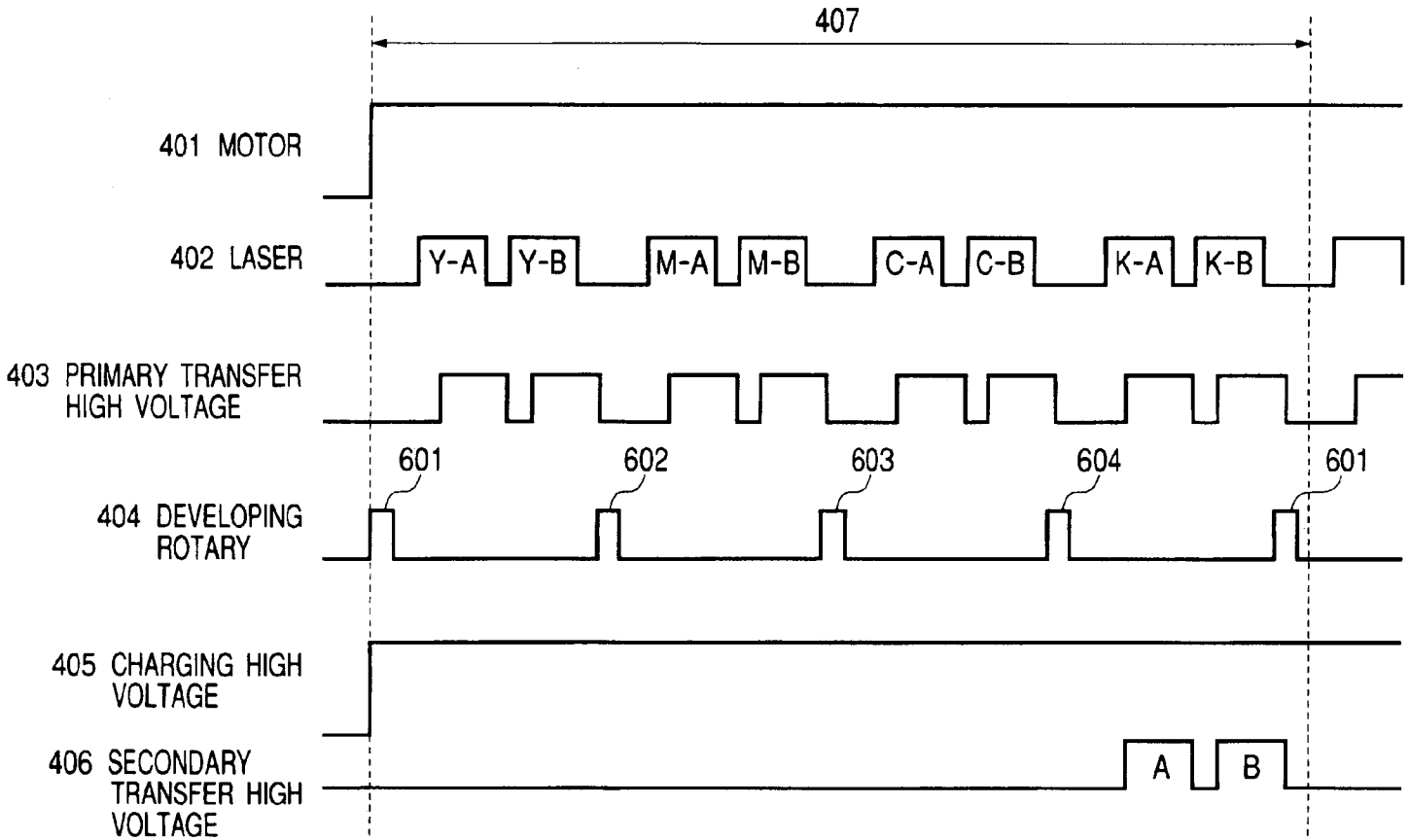
FIG. 4 is a timing chart at the time of duplex image formation of plain paper.
Figure 6:
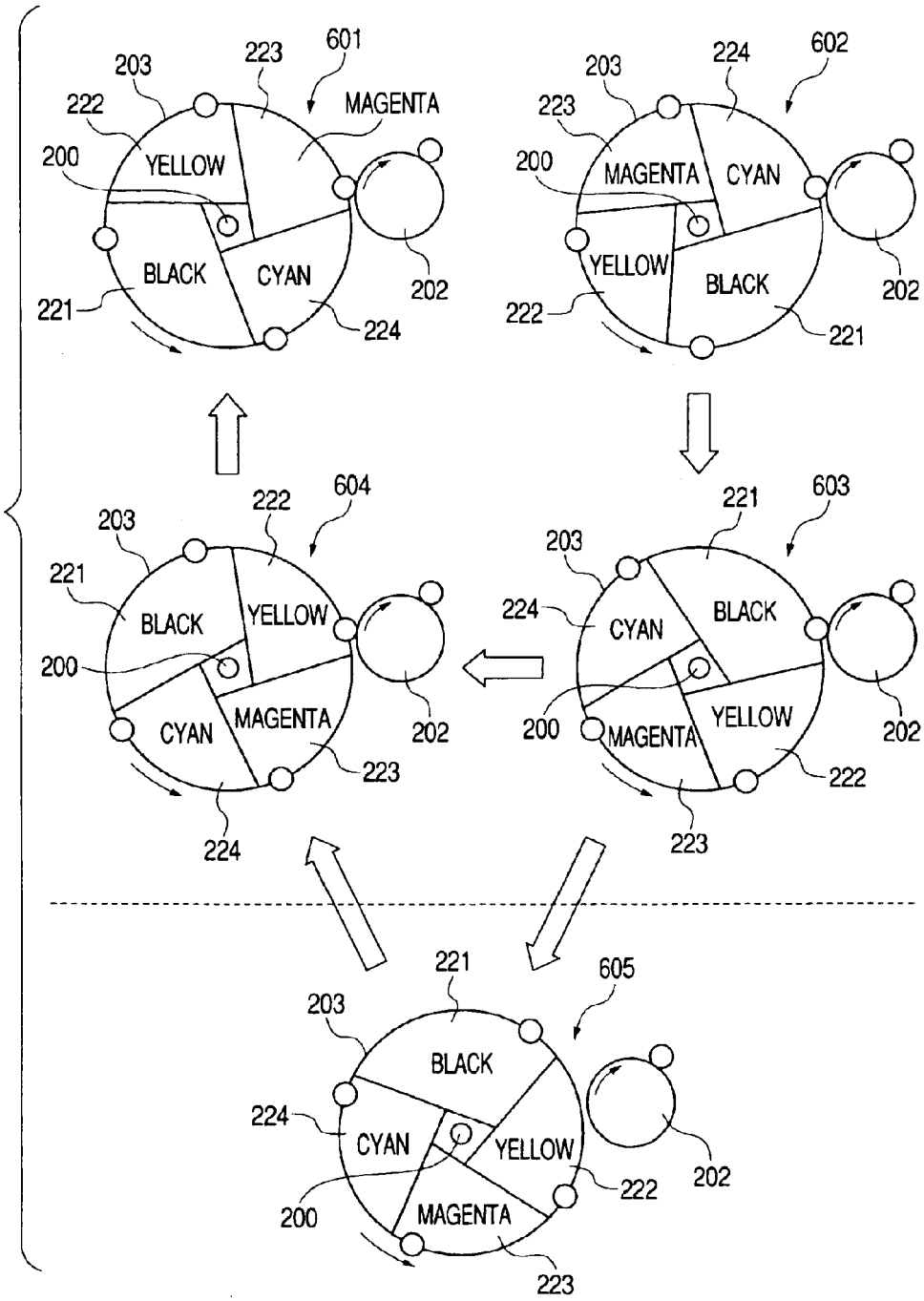
FIG. 6 shows rotation positions of a rotary color developing device.

FIG. 4 is a timing chart showing a timing of full-color image formation in the case of using plain paper as a recording sheet. Denoted by 401 is a speed change timing of a motor (not shown) for driving the photosensitive drum 202 and the intermediate transfer member 205. At the time of outputting the plain paper, the motor is driven at a speed V1 for printing the plain paper. In this state, a charging bias in which a DC voltage is superimposed on an AC voltage is applied to a charger 272. On the surface of the photosensitive drum 202 charged at −300 to −900 V with the charger 272, electrostatic latent images are formed in the order of Y, M, C, and K. In this example, simultaneous duplex image formation in A4 size or equivalent is conducted. In FIG. 4, a first image of the duplex image corresponds to Y-A, M-A, C-A, and K-B and a second image thereof corresponds to Y-B, M-B, C-B, and K-B. Denoted by 404 is a timing of rotating the rotary color developing device 203, in which 601, 602, 603, and 604 correspond to Y, M, C, and K, respectively. Rotation positions corresponding to those symbols are as shown in FIG. 6.

Denoted by 403 is a timing at which a toner image formed on the photosensitive drum 202 is transferred onto the intermediate transfer member 205. During the transfer, a primary transfer voltage is applied to a primary transfer roller 273. Denoted by 406 is a timing at which the toner image transferred onto the intermediate transfer member 205 is transferred onto a sheet. In the case of forming the black solid image, the control has only to be performed on the application of the laser (402) for K-A and the primary transfer (403), and on the secondary transfer (406) for A.

When the image formation is conducted on three or more sheets, the control indicated by 407 is repeated. That is, the developing rotary 203 is rotated to shift a condition of "603" to a condition of "604" in FIG. 6 on completion of the primary transfer during the formation of the previous image. With such a structure, the image formation can be successively started on a third sheet in a short time. In this case, unlike a "thick sheet" mode as described later, the application of the charging bias to the charger is not stopped on completion of the primary transfer to the first and second sheets but kept on. Therefore, the image formation can be successively started on the third sheet in a short time.

[In Case of Thick Sheet]

Figure 5:
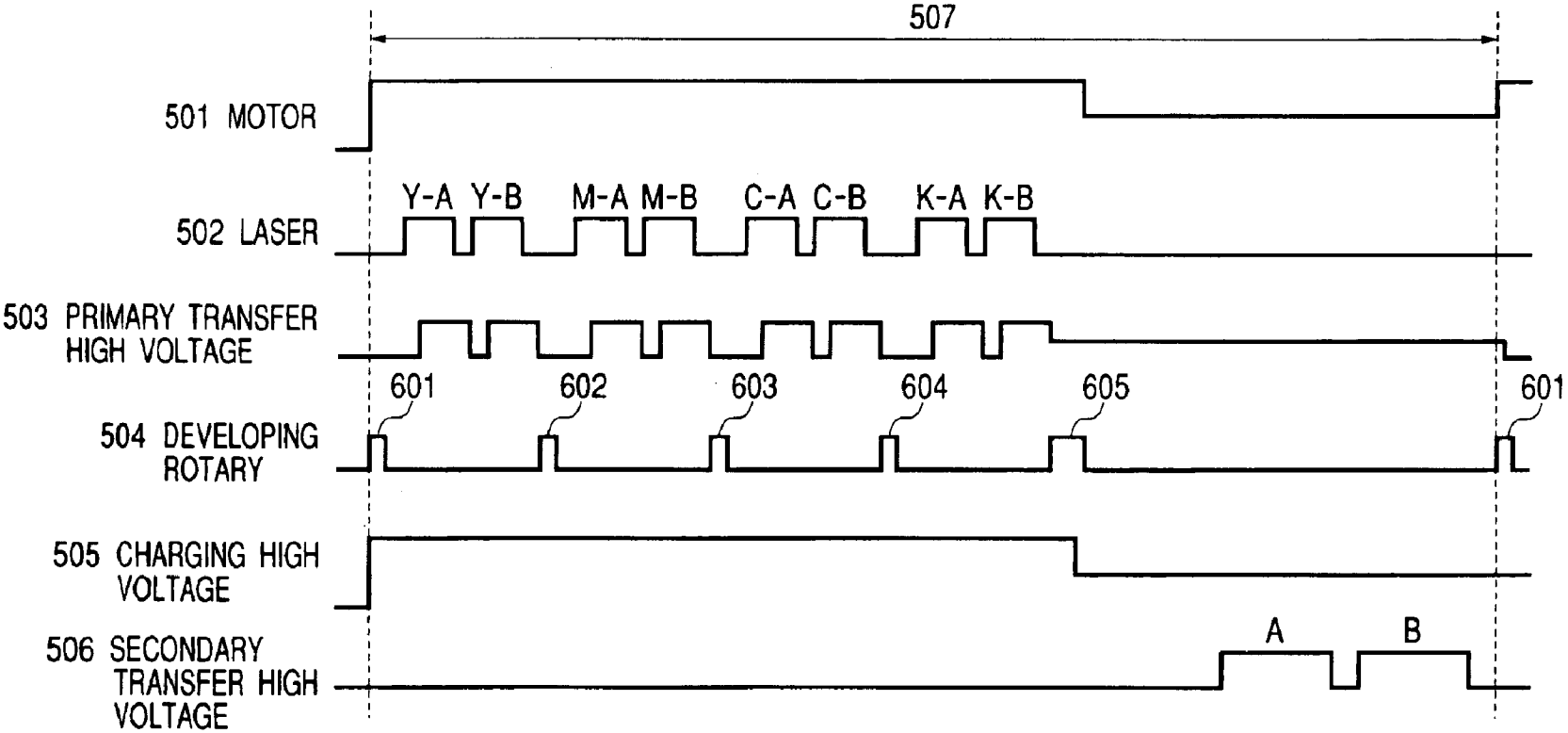
FIG. 5 is a timing chart at the time of duplex image formation of thick sheet.

FIG. 5 is a timing chart of full-color image formation in the case of using thick sheet as the recording sheet. The control timing up to the timing of the primary transfer completion is the same as the plain paper. On completion of the primary transfer, a motor is decelerated to a speed V2 (=V1/2) for printing the thick sheet. At the same time, the rotary color developing device 203 is rotated and positioned as indicated by 605 in FIG. 6 under control. After the speed of the intermediate transfer member equals V2, the secondary transfer to the recording material starts. Note that, the position as indicated by 605 in FIG. 6 is just a midpoint between developing positions in yellow (Y) and black (K). In other words, any developing device is kept off the developing position. After the primary transfer is completed, the rotary color developing device 203 is at the developing position (603) in black (K). This causes the problem about the carrier adhesion from the developing device to the photosensitive drum 202. The above control is made for solving this problem.

An AC voltage component applied to the charger 272 from the power source is turned off and a DC voltage is only applied under control on completion of the primary transfer. As a result of mechanically preventing the carrier adhesion in this way, the AC voltage component can be turned off at that time. Consequently, the AC voltage can be prevented from shortening a service life of the photosensitive member, which enables the longer service life thereof. Note that, in this case, the DC voltage may be turned off together with the AC voltage. However, in view of toner fogging or throughput (e.g., the next image formation during a continuous image formation job or the next image formation job is demanded to start as early as possible), it is preferable to keep on the application of the DC voltage until the image formation is completed to stop the photosensitive member. At this time, the DC voltage may be reduced as compared with that at the time of image formation, to such a degree as not to bring about the toner fogging.

After the motor speed stabilizes at the speed V2, a secondary transfer (506) is conducted at a timing at which the toner image on the intermediate transfer member 205 is substantially aligned with a leading edge of the conveyed sheet.

In the case of the image formation job targeted at the three or more sheets, after the image (B) is transferred at the secondary transfer (506), the motor speed is increased up to V1 again while a charging high voltage (505) is reset to a set value for the primary transfer. The application of the primary transfer high voltage is stopped.

In the case of black solid image, the control has only to be performed on the application of laser (502) for K-A, and the primary transfer (503), respectively, and on the secondary transfer (506) for A. It is assumed here that at the time of full-color image formation, the sheet size is the A4 size or larger in a sub-scanning direction and the image transfer member 205 only allows simultaneous image formation of one-sheet image. In such a case, the control has only to be performed on the application of laser (502) for Y-A, M-A, C-A, and K-A, and the primary transfer (503), and on the secondary transfer (506) for A.

As mentioned above, according to this embodiment, if the rotating speed of the intermediate transfer member is reduced in the course of image formation, the developing device is retreated from a position opposing the photosensitive member until the rotating speed of the intermediate transfer member stabilizes. Consequently, the carrier adhesion to the photosensitive member can be suppressed, for instance.

Note that, even in the midstream of the continuous image formation job for continuously forming images on the plural recording materials, the above control is performed. To elaborate, it is assumed that first and second sheet images in the continuous job (corresponding to A and B in FIG. 5) are formed on a special recording material such as A4-size thick sheet and third sheet image and its subsequent sheet images are formed on the plain paper (although not shown in FIG. 5, a sequence of FIG. 4 follows a sequence of FIG. 5 with no interval). Even in such a case, the foregoing control is performed, such as deaccelerating the rotation of the intermediate transfer member, turning off the charging bias or the AC component, or rotating the developing rotary 303 so as to keep any developing device off the developing position.

In the above, the "thick sheet" is taken as an example of the special recording material. However, even when the image is formed on an OHP sheet (light-transmissive resin for an overhead projector), the above control is performed similar to the "thick sheet". In this case, upon forming the image on the OHP sheet, the speed of the intermediate transfer member is reduced to a speed V3 (=V1/3) for printing the OHP sheet on completion of the primary transfer. At the same time, the rotary color developing device 203 is rotated to come to a position as indicated by 605 in FIG. 6. Then, the rotation of the intermediate transfer member is deaccelerated before the image on the intermediate transfer member is secondarily transferred onto the OHP sheet.

Note that, in the above, the intermediate transfer member is decelerated between the completion of the primary transfer and the start of the secondary transfer. In this case, the secondary transfer does not start immediately after the completion of the primary transfer; instead, while the intermediate transfer member makes one idle rotation, the speed is gradually reduced. After the intermediate transfer member is decelerated, the secondary transfer to the recording material starts.

In addition, in the above, the plain paper means paper having a basis weight of 64 to 105 g/m$^2$ and the thick sheet means paper having a basis weight of 106 to 163 g/m$^2$.

As regards the type of recording material, the operator makes instruction and selects the paper with the operating portion 303 having a liquid crystal display portion. The CPU (controlling device) 301 changes the speed of the intermediate transfer member as mentioned above on the basis of the selected paper information to perform the foregoing control, for example, control for rotating the developing rotary 203. Note that, a sensor is arranged in a conveyance path of the recording material inside the image forming apparatus for detecting the type of recording material and the CPU 301 may perform, based on the information from the sensor, the control, for example, control for changing the speed of the intermediate transfer member.

(Other Embodiment)

In this embodiment, the description has been made of a system in which when the motor speed is reduced from V1 to V2, the rotary color developing device is rotated in a forward direction to allow the developing device to retreat to a midpoint between the developing positions of yellow (Y) and black (K). The retreat position is not limited to this but may be a midpoint between the developing positions of other colors, i.e., may be any position insofar as any developing device is kept off the developing position under control. Also, the rotating direction of the rotary color developing device at the retreat time may be a direction opposite to the rotating direction during the normal image formation.

As mentioned above, according to the embodiments, it is possible to avoid a situation in which the developer (e.g., carrier constituting the two-component developer) adheres to an image bearing member from the developing device in changing the image formation speed (peripheral speed (process speed) of the intermediate transfer member) in accordance with the conveying speed (type) of the recording material on completion of the primary transfer. Further, in this case, a service life of the image bearing member can be prolonged by stopping a charging operation of the charger or turning off the AC component of the charging bias. In addition, the DC component of the charging bias is kept on, whereby the adhesion of the developer free in the apparatus (e.g., toner constituting the two-component developer) can be prevented.

In other words, when the speed of the intermediate transfer member is reduced according to the type of recording material after the developing operation with the developing device is completed, the situation in which the developer adheres to the image bearing member from the developing device can be prevented even if the structure of weakening a charging ability of the charger or stopping the charging is adopted for prolonging a service life of the image bearing member.

What is claimed is:

1. An image forming apparatus comprising:

an image bearing member;

a charger to which a charging bias in which a DC voltage is superimposed on an AC voltage is applied to charge the image bearing member;

electrostatic image fanning means for forming an electrostatic image on the image bearing member;

a plurality of developing devices for developing the electrostatic image on the image bearing member with a developer;

a moving member holding the plurality of developing devices and selectively moving a predetermined developing device to a developing position;

an intermediate transfer member onto which a developer image is primarily transferred from the image bearing member, the developer image on the intermediate transfer member being secondarily transferred onto a recording material; and speed reducing means for reducing a speed of the intermediate transfer member according to a type of the recording material after completion of the primary transfer, wherein in a state in which the speed of the intermediate transfer member is reduced, all of the developing devices are retreated to positions other than the developing position, wherein at least the AC voltage of the charging bias applied to said charger is turned off.

2. An image forming apparatus according to claim 1, wherein upon reducing the speed of the intermediate transfer member with said speed reducing means, the DC component of the charging bias applied to the charger is kept on.

3. An image forming apparatus according to claim 1, wherein when the speed of the intermediate transfer member is not reduced but maintained, the moving member is actuated to move the next developing device to the developing position.

4. An image forming apparatus according to claim 1, wherein when the recording material is formed of a light-transmissive resin, the speed reducing means reduces the speed of the intermediate transfer member.

* * * * *

UNITED STATES PATENT AND TRADEMARK OFFICE

CERTIFICATE OF CORRECTION

PATENT NO. : 6,947,680 B2
DATED : September 20, 2005
INVENTOR(S) : Yushi Oka et al.

It is certified that error appears in the above-identified patent and that said Letters Patent is hereby corrected as shown below:

Title page,
Item [56], References Cited, FOREIGN PATENT DOCUMENTS,
"60078465" should read -- 60-078465 --.

Column 5,
Line 57, "rollers 212/213/234/215" should read -- rollers 212/213/214/215 --.

Column 8,
Line 45, "deaccelerating" should read -- decelerating --; and
Line 60, "deaccelerated" should read -- decelerated --.

Column 10,
Line 14, "fanning" should read -- forming --.

Signed and Sealed this

Twenty-eighth Day of February, 2006

JON W. DUDAS
*Director of the United States Patent and Trademark Office*